US005327684A

United States Patent [19]

Herbst

[11] Patent Number: 5,327,684

[45] Date of Patent: Jul. 12, 1994

[54] REVERSIBLE DOOR HINGE AND METHOD

[76] Inventor: Walter Herbst, 86 Salem La., Evanston, Ill. 60203

[21] Appl. No.: 3,627

[22] Filed: Jan. 13, 1993

[51] Int. Cl.[5] ..... E06B 3/00; E05D 7/02

[52] U.S. Cl. ..... 49/506; 16/382; 49/382

[58] Field of Search ..... 49/382, 506, 501; 16/382, 387

[56] References Cited

U.S. PATENT DOCUMENTS

| | | | |
|---|---|---|---|
| 1,743,273 | 1/1930 | Hammer | 16/382 X |
| 1,973,579 | 9/1934 | Ryan et al. | 16/382 X |
| 3,296,743 | 1/1967 | Curl | 49/382 |
| 3,298,135 | 1/1967 | Kinser | 49/382 X |
| 4,001,972 | 1/1977 | Hurwitz | 49/382 X |
| 4,106,238 | 8/1978 | Bonello | 49/382 |
| 4,308,692 | 1/1982 | Rumble | 49/382 X |
| 4,311,183 | 1/1982 | Herbst et al. | 49/501 X |
| 4,631,866 | 12/1986 | Otto et al. | 49/382 X |

*Primary Examiner*—Philip C. Kannan
*Attorney, Agent, or Firm*—Jack E. Dominik

[57] ABSTRACT

A kit including a full door piano hinge and frame mount for one lateral edge of a door is disclosed. Door edge trim for mounting on the closing side of the door may be optionally employed. While the hinge and frame mount are integral, they are reversible and hence can be positioned on either side of a door prior to mounting in the door jamb and frame. The latch assembly is then applied to either the left or the right-hand side depending upon how the door is hinged and hung. More specifically the hinge is provided with a plurality of holes in one of its leaves which permits the same to be secured to one lateral edge of the door with screws already in place awaiting the placement of the hinge. In one embodiment of the method, taken in conjunction with the door of U.S. Pat. No. 4,311,183, the lateral edge screws are relieved by one to two turns from the hinge side. The hinge leaf mounting surface is provided with keyhole slots which are positioned against the shank of the relieved screw. Thereafter the screws are re-tightened. The latch and handle are then installed after boring a hole through the door to accept the actuating shaft.

2 Claims, 5 Drawing Sheets

REVERSIBLE DOOR HINGE AND METHOD

FIELD OF THE INVENTION

The present invention is directed to the broad subject matter of a hinge and trim kit and method for mounting on a door to the end that a single stock door from inventory can be installed at the job site in a left-hand or right-hand configuration.

SUMMARY OF THE PRIOR ART

The present invention finds utility in a one specific embodiment door of the prior art as exemplified by U.S. Pat. No. 4,311,183 issued Jan. 19, 1982, entitled "Combination Storm and Screen Self Storing Door". The subject patent discloses a storm door made up of two molded frame sections, one an outer frame and one an inner frame, which are joined at their lateral edges by a plurality of screws. The screws secure overlapping flanges on the front and the rear panel oriented at the lateral edges. The flanges are essentially perpendicular with the plane of its frame. The door latch mechanism as well as the hinge is secured exteriorly to the door structure, and may be mounted on the left side or the right side. Factory installation of the hinge precludes the door from having a left-hand or right-hand mount which is normally decided at the job site.

Statistically, left-hand and right-hand doors constitute almost a 50/50 split in inventory with the building supply dealer. Accordingly, the dealer needs to maintain essentially double the inventory that would otherwise be maintained in the event the doors could be made in a non-direction mode, and a kit made available to mount the same in a left-hand or right-hand mode.

SUMMARY OF THE INVENTION

The present invention is directed to a kit including a full door piano hinge and frame mount for one lateral edge of a door. Door edge trim for mounting on the closing side of the door may be optionally employed. While the hinge and frame mount are integral, they are reversible and hence can be positioned on either side of a door prior to mounting in the door jamb and frame. The latch assembly is then applied to either the left or the right-hand side depending upon how the door is hinged and hung. More specifically the hinge is provided with a plurality of holes in one of its leaves which permits the same to be secured to one lateral edge of the door with screws already in place awaiting the placement of the hinge. In one embodiment of the method, taken in conjunction with the door of U.S. Pat. No. 4,311,183, the lateral edge screws are partially unscrewed from the hinge side when installing the hinge. The hinge leaf mounting surface is provided with keyhole slots which are positioned against the shank of the relieved screw. Thereafter the screws are tightened. The latch and handle are then installed after boring a hole through the door to accept the actuating shaft.

In view of the foregoing, it is a principal object of the present invention to provide a kit for modifying a door such as a storm door by the home owner or installer to fit a left-hand or right-hand configuration with a simplicity of tools and, where desired, at the job site.

Another and related object of the present invention is to provide a single door which can be mounted in a left-hand or right-hand configuration along with a mounting kit including a hinge and integral frame mount which permits the door to be converted to left-hand or right-hand thereby significantly reducing the inventory required for the distributor.

Another and important object of the present invention is to provide a kit and, indeed, a door for left-hand or right-hand installation, the cost of which is substantially the same as the subject matter would be if factory installed in the left-hand or right-hand configuration.

BRIEF DESCRIPTION OF THE ILLUSTRATIVE DRAWINGS

The subject invention will be better understood when reviewed in conjunction with the accompanying illustrative drawings, in which.

Figure 3:
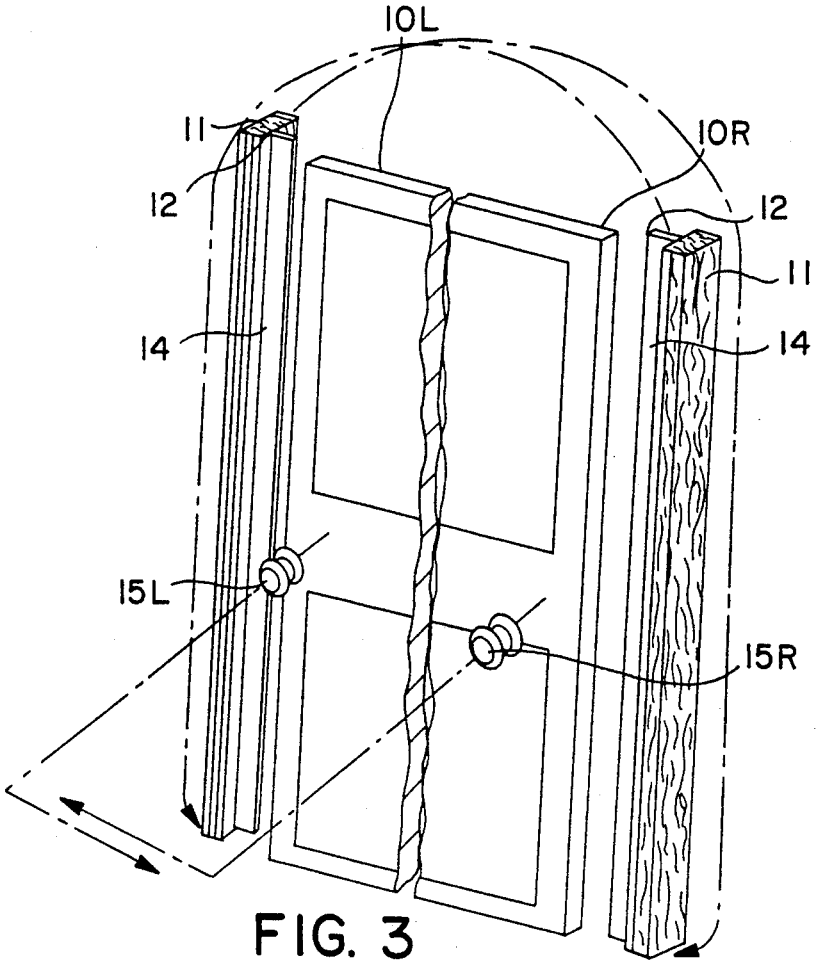
FIG. 3 is an exploded perspective partially diagrammatic view showing how the specific full length piano-like hinge can be employed on the left hand or right hand side of a door with an independent handle and latch to make it either a left-hand or right-hand door depending upon how the hinge is attached.
Figure 4:
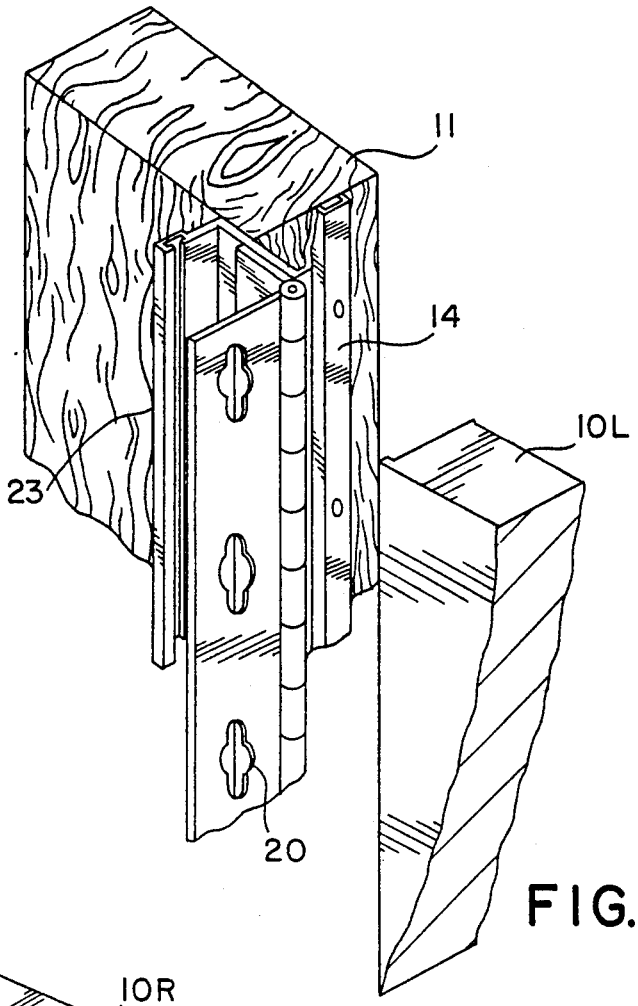
Figure 5:
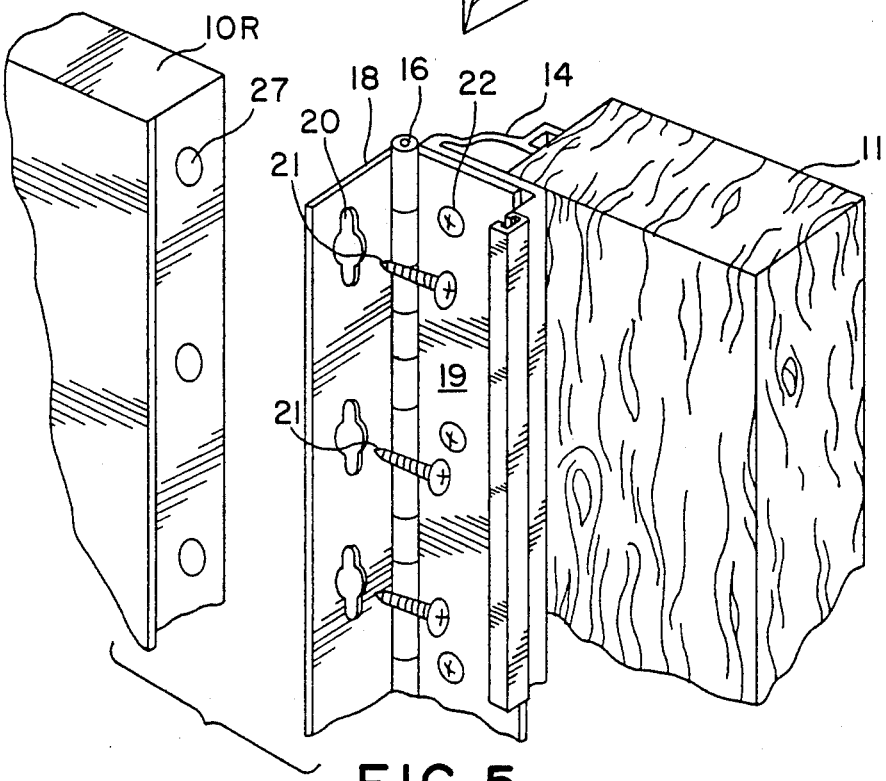
Figure 7:
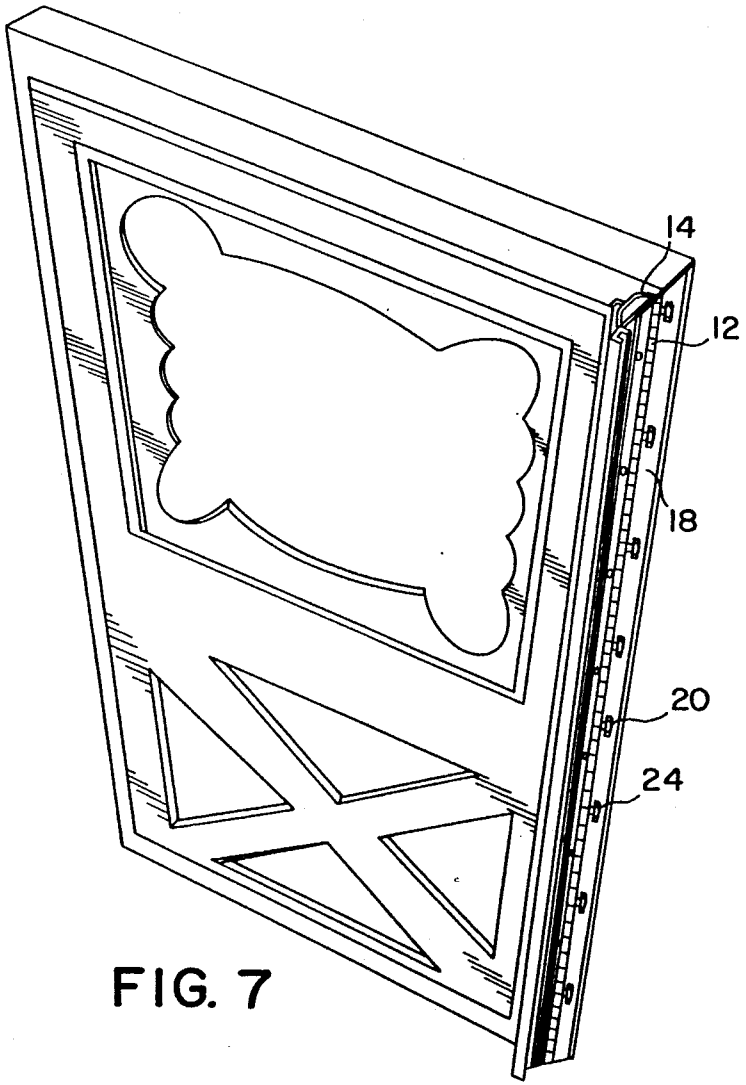
Figure 6:
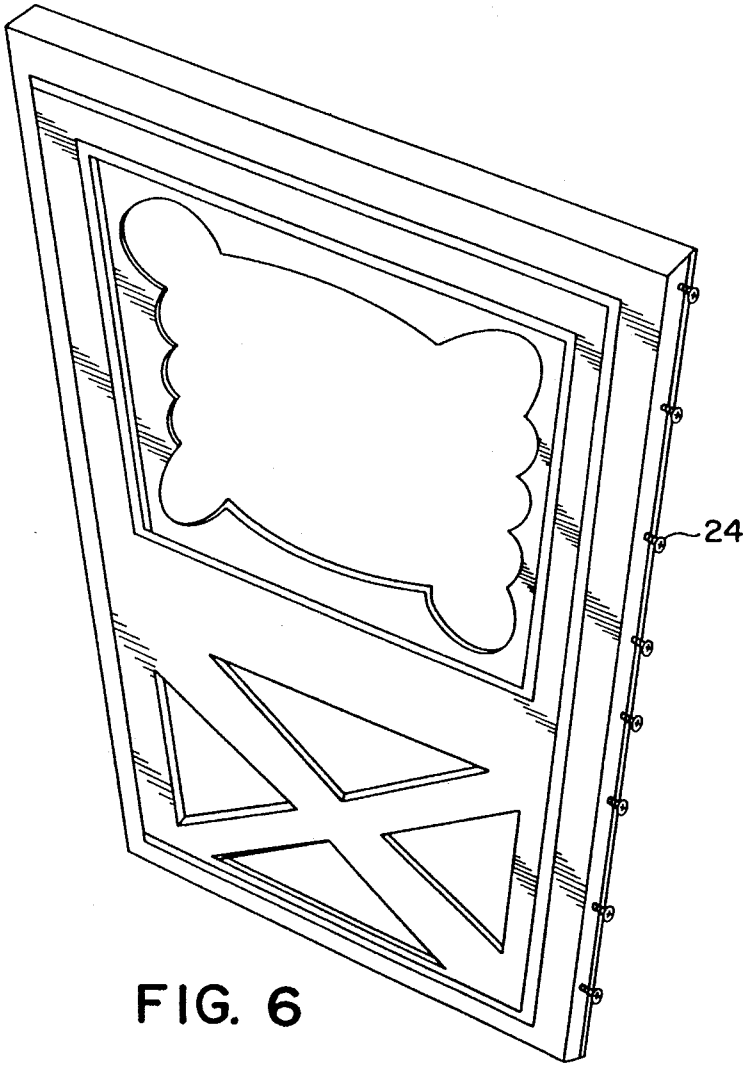
Figure 9:
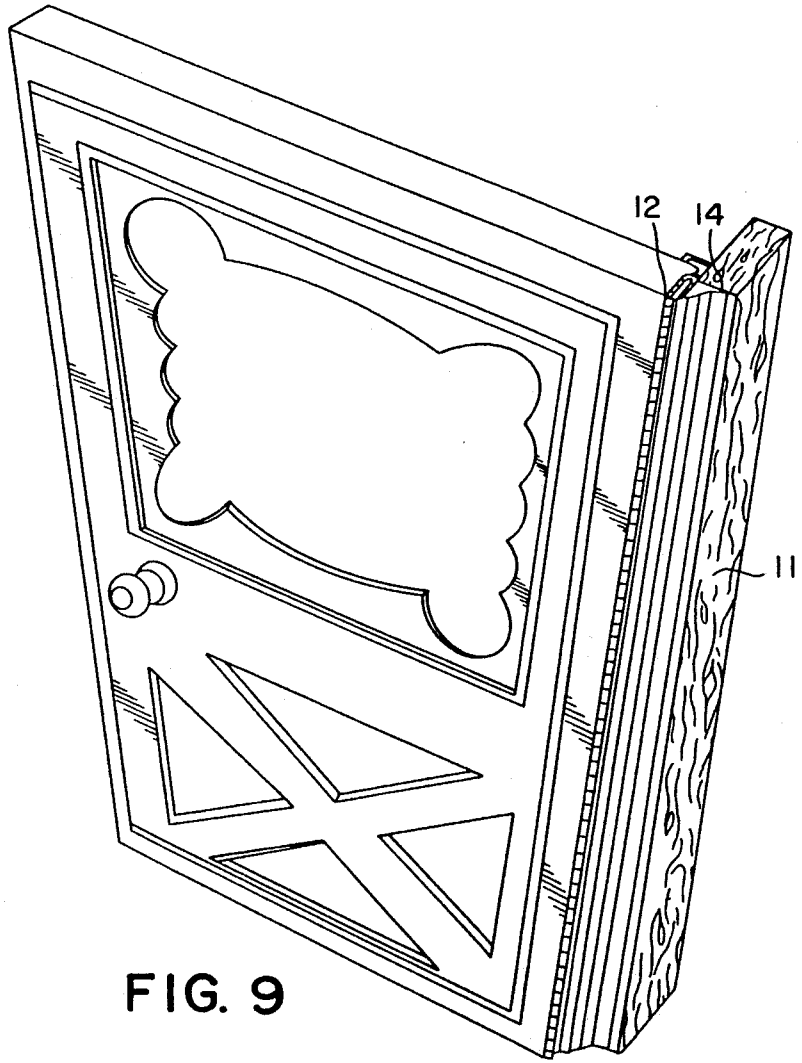
Figure 8:
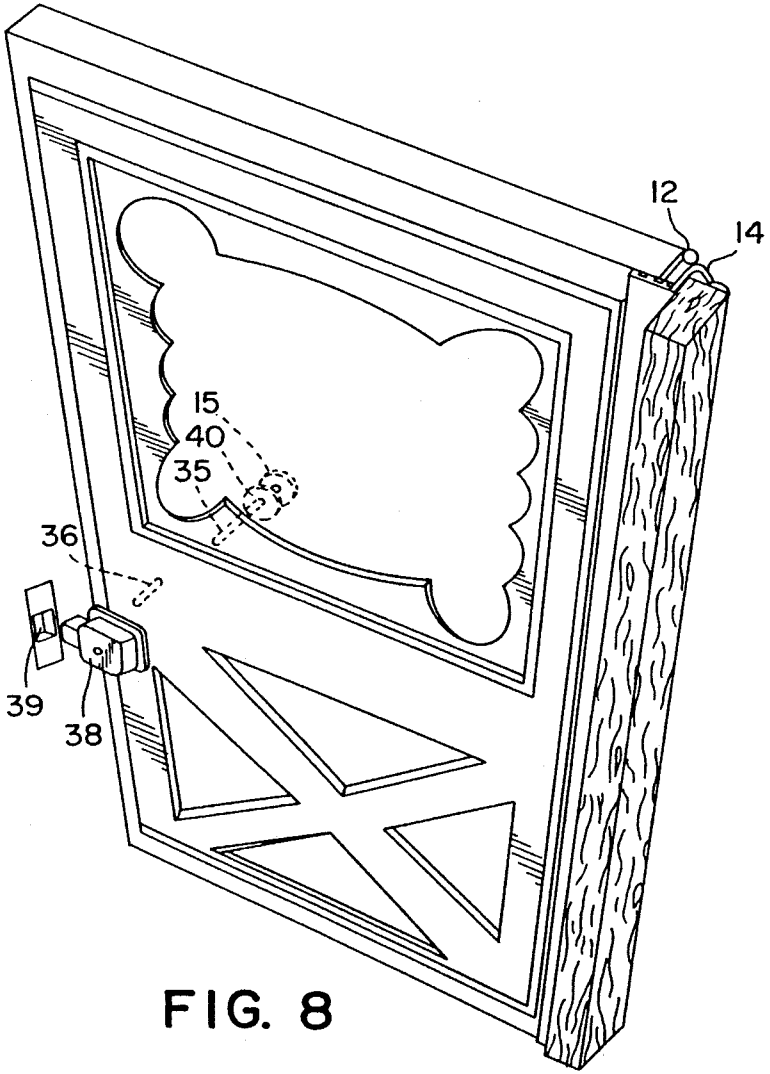

FIG. 4 exploded perspective partially broken view of the hinge and decorative mounting frame shown in FIG. 3. It is shown in the right hinge door configuration;

FIG. 5 is an exploded perspective partially broken view of the hinge and decorative mounting frame shown in FIG. 3. It is shown in the left hinge door configuration;

FIG. 6 is the first step for mounting a door such as illustrated in U.S. Pat. No. 4,311,183, whereas the screws installed at the factory and used to hold the door together, are partially unscrewed by one to two rotations;

FIG. 7 is a view sequential to that of FIG. 6 showing how the hinge is applied to the screws which were loosened as shown in FIG. 6;

FIG. 8 is an interior view sequential to that of FIG. 7 showing how the door with hinge is secured to the frame into which the door is hung with the handle and latch shown diagrammatically;

FIG. 9 illustrates applying the handle; and

Figure 10:
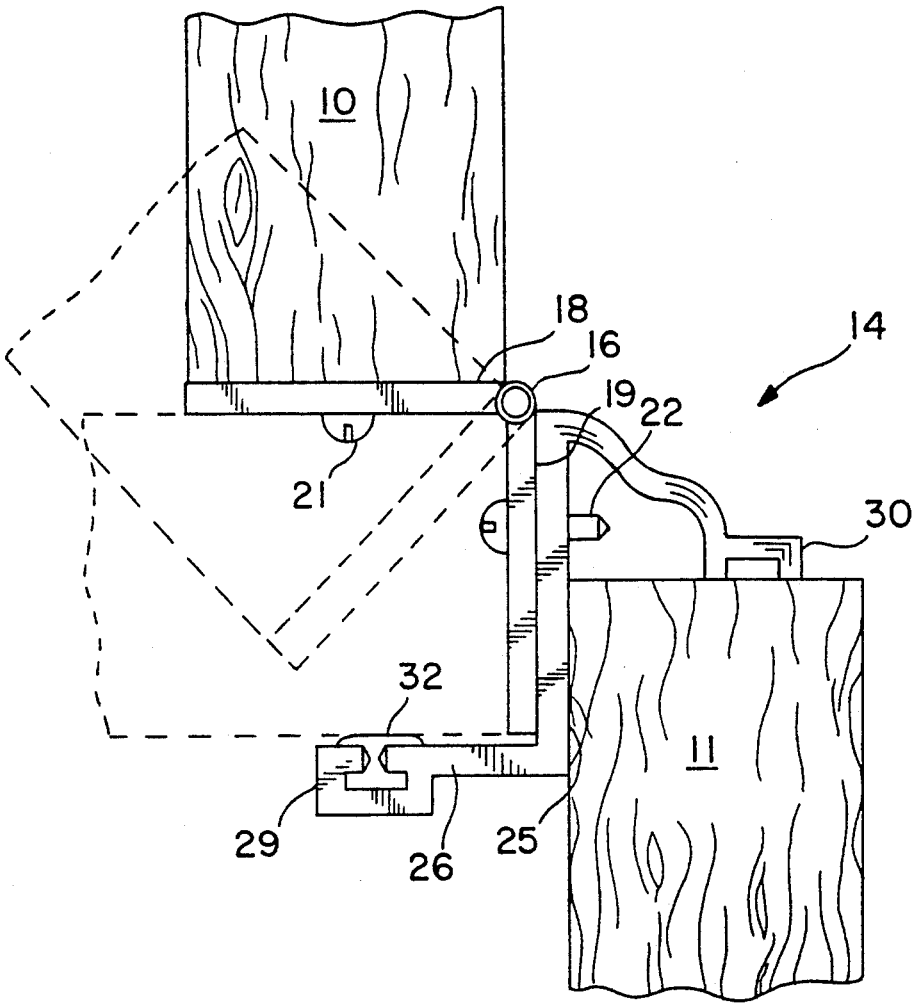

FIG. 10 is an enlarged view of the hinge frame mount showing its relationship to the door and frame.

DESCRIPTION OF FIRST EMBODIMENT

Figure 1:
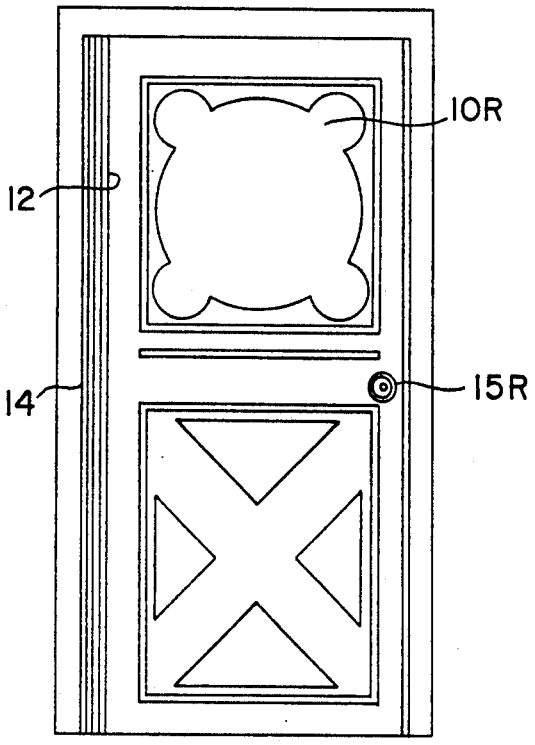
FIG. 1 is a front partially diagrammatic view of a door of the right-hand variety (left hinge)
Figure 2:
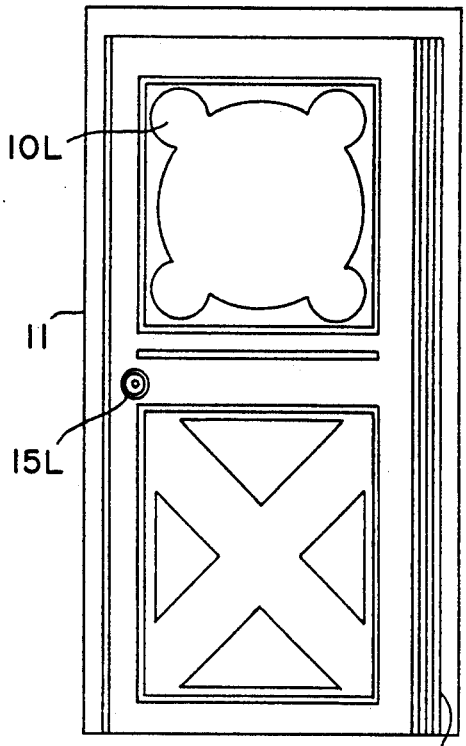
FIG. 2 is a view comparable to FIG. 1 with a door of the left-hand variety (right hinge)

The first embodiment of the present invention is shown in FIGS. 1 and 2 where they, in turn, show a door of the type disclosed in U.S. Pat. No. 4,311,183 issued Jan. 19, 1982, which door is made up of two molded halves, front and rear. The door is then screwed together at the lateral edges. As will be seen, FIG. 1 is a right-hand door 10R secured to the Z-bar or hinge frame mount 14 by means of hinge 12 and the ultimate attachment to the door frame 11. The handle is a right-hand handle 15R and becomes such because of its position. The door shown in FIG. 2 is a left-hand door since its handle 15L is mounted on the left-hand side. The hinge 12 and the hinge mount 14 are on the right-hand side. As set forth above, it is remarkable that architectural statistics have shown that the number of right-hand and left-hand doors is almost split evenly throughout major applications and households, offices, and the like.

Turning now to FIG. 3, it will be seen how the reversible aspect of the illustrative embodiment is achieved. There it will be seen, because the door is broken, that both a left-hand and right hand door are illustrated in juxtaposed relationship. The left-hand panel 10L is to the left and the right-hand panel 10R is to the right. Similarly, the left-hand handle 15L is to the left and the right-hand handle 15R is to the right. The arrows extending from the projected center lines of the handles show the reversible application of the handle and its oppositely mounted latch (to be described later). As shown, the hinge 12 and the hinge frame mount 14 are integral, and can be inverted from one side to the other. The elongated phantom lines and arrows illustrate this relationship. As a consequence of the unitary hinge and its frame mount portion, particularly with the door of U.S. Pat. No. 4,311,183 it can be inventoried as an ambidextrous door along with the hardware for mounting it in place in the door frame. At the job site, however, depending on which side of the door hinge assembly is mounted, and this dictates of course the side that the handle is mounted, the door then becomes a left-hand or a right-hand door.

Turning now to FIG. 4, it will be seen how a wooden door 10L becomes the right hinge mounted door when secured to the hinge 12 and hinge jamb mount 14. The jamb 11 is shown and is common to both embodiments. To be noted also, as set forth earlier, the hinge assembly 12 and the hinge frame mount are integral and factory supplied in that configuration.

In FIG. 5 the procedure is essentially the same, except it shows there mounting a right-hand door 10R which is of the configuration shown in U.S. Pat. No. 4,311,183. There it will be seen that the hinge slots 20 receive door screws 21, and are used to connect the same to the frame of the door 10R. Predrilled holes 27 are provided for this purpose.

It should be noted particularly in FIGS. 4 and 5 that the hinge slots 20 have a central opening to pass the head of the door screws 21, and then a pair of vertically oriented opposed shank slots 23 extending upwardly and downwardly. In essence, the door is hung in the shank slots. Because the slots are symmetrically opposed at the opening for the head of the screw 21, when the hinge is reversed, the orientation for mounting remains the same. In essence the door slots 20 are a modified keyhole-like silouhette. Also contemplated is an orientation of the shank slots 23 to where they would extend horizontally in one direction or the other.

In FIG. 6, again the door illustrative of U.S. Pat. No. 4,311,183 has had its door screws 24 loosened in order to receive the hinge assembly through the hinge slots 20 as illustrated in FIG. 7. The screws are then re-tightened. It will be seen from a review of FIG. 8 that a hole 36 is drilled through the door and thereafter the latch assembly 38 along with the door frame catch 39 is assembled.

Once the door is totally hung in place with the jamb 11, particularly as shown in FIG. 9, then the shaft and screw holes are drilled on the side selected for the handle hole 36, and the shaft 35 inserted through the same permitting the handle 15 to be in its proper orientation. Thereafter the base plate 40 of the handle is secured to the door. This completes the installation as the latch and lock are externally mounted and do not require a modest installation.

Specific details of the relationship between the door 10 and the frame 11, and hinge 12 with its hinge frame mount 14 are shown in FIG. 5 and FIG. 10. There it will be seen that the hinge frame mount 14 has a decorative somewhat fluted exterior which is dictated as much by aesthetics as its structural requirements. Such hinge door frame mounts 14 are often referred to as Z-bars. Reference is made to the hinge door frame being mounted to the Z-bar, or the Z-bar surrounding the door opening. This orientation is not necessarily limited to the hinge side. The hinge web 25 of the mount 14 or Z-bar is essentially uniform in cross-section and flat. A door web 26 extends perpendicular to the hinge web 25 as shown, and contains an insulating stop 29 in which insulation 32 may be inserted. On the other side, there is provision made for a frame mount channel 30 which is normally secured by means of frame screws 22 into the frame 11. The door 10, on the other hand, is screwed by means of door screws 21 to attach the door leaf 18 to the door 10.

The Method

The method presupposes the utilization of a full length piano-type hinge and frame support member in conjunction with a door, in one embodiment having screws on its lateral edges holding two parts together, and in an alternative embodiment being wood or otherwise penetrable by means of screws. Separately, a handle with a shaft and latch are provided. The door hinge assembly is then mounted to the left-hand or right-hand side of the door or the frame depending upon the option of the installer. The hinge and mount may be reversed for a left-hand or a right-hand configuration as illustrated in FIG. 3. Once the door is hung, the hole for the handle shaft is bored, or it may be bored prior to hanging, and then the handle assembly installed essentially as indicated in FIGS. 8 and 9.

Where the door of U.S Pat. No. 4,311,183 is used, the hinge frame mount 14 is both functional and decorative. It is often known as a hinge/Z-bar which is normally factory installed. The latch assembly is installed by the end user using predrilled holes which are developed during the post assembly operations by the factory. In accordance with the method of the invention, the combination reversible hinge and hinge frame mount are not attached to the door at the factory. Additionally, the factory no longer predrills the holes for the latch which will be done at the job site when the door is installed as an optional left-hand or right-hand door. The lateral mounting screws of the patented door of U.S. Pat. No. 4,311,183 are drawn down on either side of the door during assembly by the factory and then the side determined by the installer to accept the hinge has its screws backed off one to two turns. Sufficient space is then available to apply the door leaf of the hinge through its keyhole type holes to engage the shank of each of the screws. This is done on the left-hand or right-hand side depending upon the engagement intended. The screws on the hinge side of the door are then re-screwed down over the full length of the piano hinge giving the door sufficient strength. After the door is mounted to the jamb, or before if need be, the holes for the handle and latch assembly are drilled, and the same mounted in place. When desired, additional holes can be mounted in the hinge between the door slots 20, and thereafter additional screws inserted through such additional holes to further strengthen the relationship between the hinge and the door.

In review it will be seen that a hinge and mount kit coupled with a door handle and latch assembly are provided which can accept a door which does not know whether it is a left-hand or right-hand door, and accommodate the same in either a left-hand or right-hand configuration. Important to the invention is that the hinge be of a piano type and full length and have one leaf permanently secured to the hinge frame mount or Z-bar.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A method for mounting a hinge and latch on a door blank to install the same as either a left-hand or right-hand door wherein the door is made up of front and rear members, each of said members having lateral edges for overlapping engagement with its mating opposite member, and said opposite mating members being screwed together by a plurality of screws spaced up and down both lateral edges of the door, the method comprising the steps of mounting, to a lateral door edge, a full length hinge member having a door leaf and a jamb leaf hingedly joined by a knuckle and a door edge trim member secured to the jamb leaf comprising, providing the hinge door leaf with a plurality of longitudinally spaced holes thereon with a silhouette of a modified heyhole slot to match the pre-existing screws on one lateral edge of the pre-existing screws on one lateral edge of the door, relieving the screws holding one lateral edge of the door together thereby defining relieved screws, thereafter applying the hinge door leaf with the keyhole slots in position over the head and shank of the relieved screws, and subsequently re-tightening the previously relieved screws and their related hinge door leaf to secure the same firmly to the door, and then mounting a latch at the opposite side of the hinge and securing the latch interiorly to the door.

2. In the method of claim 1, above, the additional step of providing additional holes in the hinge between the heyhole slots intended to receive the relieve screws of the door, and thereafter inserting screws through the additional holes to further strengthen the relationship between the hinge and the door.

* * * * *